US009120303B2

(12) United States Patent
Murakami et al.

(10) Patent No.: US 9,120,303 B2
(45) Date of Patent: Sep. 1, 2015

(54) SHEET PROCESSING APPARATUS HAVING REVERSING SWING ARM SHAFT PREGRIPPER

(71) Applicants: Satoshi Murakami, Ibaraki (JP); Takanobu Aoki, Tokyo (JP); Shinya Matsuyama, Ibaraki (JP); Hayato Kondo, Ibaraki (JP); Naoki Ogawa, Ibaraki (JP); Mikio Kamata, Ibaraki (JP); Soju Watanabe, Ibaraki (JP); Yasuhiro Suzuki, Yamagata (JP)

(72) Inventors: Satoshi Murakami, Ibaraki (JP); Takanobu Aoki, Tokyo (JP); Shinya Matsuyama, Ibaraki (JP); Hayato Kondo, Ibaraki (JP); Naoki Ogawa, Ibaraki (JP); Mikio Kamata, Ibaraki (JP); Soju Watanabe, Ibaraki (JP); Yasuhiro Suzuki, Yamagata (JP)

(73) Assignee: KOMORI CORPORATION, Tokyo (JP)

( * ) Notice: Subject to any disclaimer, the term of this patent is extended or adjusted under 35 U.S.C. 154(b) by 103 days.

(21) Appl. No.: 13/868,996

(22) Filed: Apr. 23, 2013

(65) Prior Publication Data

US 2013/0276652 A1 Oct. 24, 2013

(30) Foreign Application Priority Data

Apr. 24, 2012 (JP) ..... 2012-098714

(51) Int. Cl.

| | |
|---|---|
| ***B41F 21/04*** | (2006.01) |
| ***B41F 21/10*** | (2006.01) |
| ***B41J 3/60*** | (2006.01) |
| ***B41J 13/22*** | (2006.01) |

(52) U.S. Cl.

CPC ..... *B41F 21/104* (2013.01); *B41F 21/102* (2013.01); *B41F 21/108* (2013.01); *B41J 3/60* (2013.01); *B41J 13/223* (2013.01)

(58) Field of Classification Search

CPC ..... B41F 21/104; B41F 21/106; B41J 3/60; B41J 11/42; B41J 29/393; B41J 29/38; B41J 11/002; B41J 11/007; B65H 29/06; B65H 29/08; B65H 9/002; B65H 9/101

USPC ..... 101/229, 230, 231, 232, 246

See application file for complete search history.

(56) References Cited

U.S. PATENT DOCUMENTS

| | | | | |
|---|---|---|---|---|
| 4,362,099 | A | 12/1982 | Iwamoto | |
| 6,009,807 | A * | 1/2000 | Yoshida et al. | 101/177 |
| 6,401,610 | B1 | 6/2002 | Becker et al. | |

(Continued)

FOREIGN PATENT DOCUMENTS

| | | | |
|---|---|---|---|
| CN | 1243063 | A | 2/2000 |
| CN | 1428244 | A | 7/2002 |

(Continued)

*Primary Examiner* — Leslie J Evanisko

(74) *Attorney, Agent, or Firm* — Blakely Sokoloff Taylor & Zafman

(57) ABSTRACT

A sheet processing apparatus including a sheet supply device, a first cylinder which includes at least one gripper device, a processing device, a sheet discharge device, and conveyance devices. The conveyance devices include a plurality of gripper devices including at least one reversing gripper device. The conveyance devices also include a second cylinder and reversing swing arm shaft pregripper. The second cylinder grips and conveys one edge of the sheet by one gripper device of the plurality of gripper devices. The reversing swing arm shaft pregripper is supported to be swingable between the first cylinder and the second cylinder, receives by the reversing gripper device the other edge of the sheet conveyed by the second cylinder, and transfers the received other edge of the sheet to the gripper device of the first cylinder by a gripping change.

3 Claims, 12 Drawing Sheets

(56) References Cited

U.S. PATENT DOCUMENTS

| | | | | |
|---|---|---|---|---|
| 6,438,352 | B1 | 8/2002 | Landa et al. | |
| 6,851,360 | B2 * | 2/2005 | Iwamloto | 101/230 |
| 2002/0092432 | A1 | 7/2002 | Stephan | |
| 2003/0019377 | A1 | 1/2003 | Stephan et al. | |
| 2003/0121433 | A1 | 7/2003 | Helmstadter et al. | |
| 2008/0092607 | A1 | 4/2008 | Schmidt et al. | |
| 2012/0069114 | A1 | 3/2012 | Kaneko et al. | |

FOREIGN PATENT DOCUMENTS

| | | | |
|---|---|---|---|
| CN | 1365889 | A | 8/2002 |
| CN | 101148117 | A | 3/2008 |
| JP | S57-219058 | A | 12/1983 |

* cited by examiner

SHEET PROCESSING APPARATUS HAVING REVERSING SWING ARM SHAFT PREGRIPPER

BACKGROUND OF THE INVENTION

The present invention relates to a sheet processing apparatus including a sheet reversing mechanism which performs a process such as printing on the obverse surface of a sheet, and subsequently performs a process such as printing on the reverse surface of the sheet.

Conventionally, a sheet-fed offset rotary printing press including a sheet reversing mechanism which prints on the obverse surface of a sheet, and subsequently prints on the reverse surface of the sheet upon turning the sheet has been proposed. The conventional sheet-fed offset rotary printing press equipped with a reversing mechanism includes a first printing unit which prints on the obverse surface of a sheet, a second printing unit which is arranged adjacent to the first printing unit and prints on the reverse surface of the sheet, and a sheet reversing unit which turns the sheet in the interval between the first and second printing units. With such an arrangement, one printing press is capable of single- and double-sided printing.

However, the above-mentioned conventional sheet-fed offset rotary printing press equipped with a reversing mechanism is independently provided with a first printing unit which prints on the obverse surface of a sheet, and a second printing unit which prints on the reverse surface of the sheet, so the entire printing press occupies a large space and has a large size.

SUMMARY OF THE INVENTION

It is an object of the present invention to provide a compact sheet processing apparatus capable of printing on both the obverse and reverse surfaces of a sheet.

In order to achieve the above-mentioned object, according to the present invention, there is provided a sheet processing apparatus comprising a sheet supply device which supplies sheets one by one, a first cylinder which comprises at least one gripper device that grips one edge of the sheet supplied from the sheet supply device, and grips and conveys the sheet by the gripper device, a processing device which processes the sheet conveyed by the first cylinder, a sheet discharge device which discharges the sheet processed by the processing device, and conveyance devices which include a plurality of gripper devices including at least one reversing gripper device that grips and holds the other edge of the sheet, convey the sheet that has undergone a single-sided process and is received from the first cylinder while sequentially transferring the sheet by a gripping change by the plurality of gripper devices, reverse the sheet in the process of conveyance, and supply the sheet onto the first cylinder, the conveyance devices comprising a second cylinder which grips and conveys one edge of the sheet by one gripper device of the plurality of gripper devices, and a reversing swing arm shaft pregripper which is supported to be swingable between the first cylinder and the second cylinder, receives by the reversing gripper device the other edge of the sheet conveyed by the second cylinder, and transfers the received other edge of the sheet to the gripper device of the first cylinder by a gripping change.

According to the present invention, since a sheet conveyance operation and reversal operation are performed by a gripping change only by a gripper device, it is possible to obtain high obverse/reverse registration accuracy. Also, since obverse printing and reverse printing are performed using the same printing cylinder, it is possible to attain a compact digital printing apparatus which performs high-quality double-sided printing on a sheet without increasing the size of the entire apparatus.

DESCRIPTION OF THE PREFERRED EMBODIMENTS

A sheet processing apparatus according to the present invention will be described in detail below with reference to the accompanying drawings.

Arrangement of Digital Printing Apparatus

Figure 1:
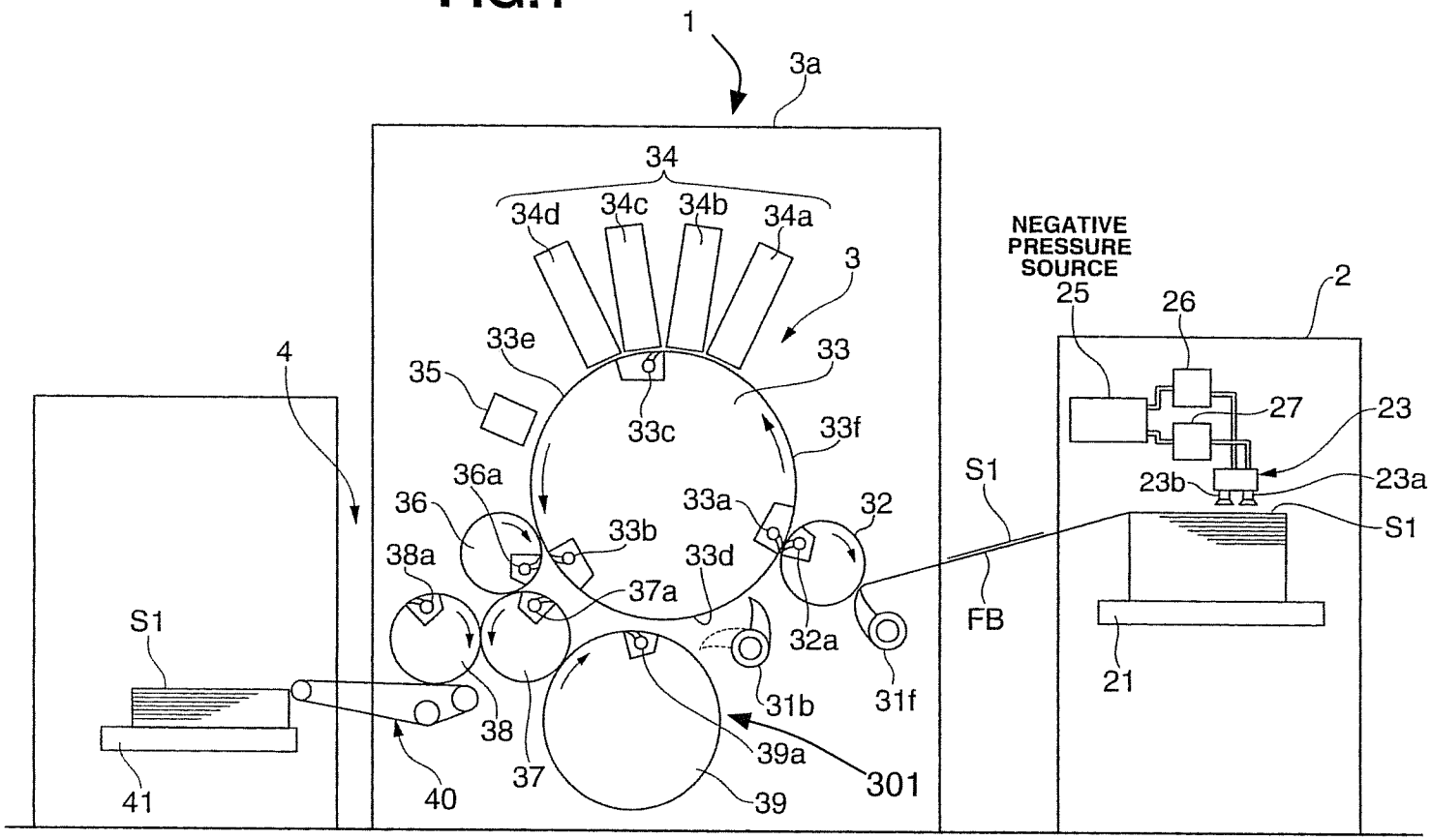
FIG. 1 is a side view showing the schematic arrangement of a digital printing apparatus according to an embodiment of the present invention.

A digital printing apparatus 1 (sheet processing apparatus) according to this embodiment includes a sheet feed device 2 (sheet supply device), a digital printing unit 3 (processing unit), and a sheet delivery device 4 (sheet discharge device), as shown in FIG. 1.

The sheet feed device 2 includes a pile board 21 on which a plurality of sheets S1 are stacked, and a sucker device 23 which conveys the top sheet S1 on the pile board 21 onto a feeder board FB. The sucker device 23 includes a pair of suction ports 23*a* and 23*b*, which are connected to a negative pressure source 25 via a continuous supply valve 26 and an intermittent supply valve 27.

The continuous supply valve 26 and intermittent supply valve 27 enable/disable, at different timings, the suction operation of the suction ports 23*a* and 23*b* using a negative pressure from the negative pressure source 25.

A swing arm shaft pregripper 31*f* is disposed on the distal end side of the feeder board FB in the sheet conveyance direction. The swing arm shaft pregripper 31*f* is swingably supported on a frame 3*a* of the digital printing unit 3, and includes a gripper device (not shown) which grips and holds the leading edge (front edge) of the sheet S1 as its one edge. A feed-side transfer cylinder 32 is opposed to the swing arm shaft pregripper 31*f*, and rotatably supported on the frame 3*a*. A gripper device 32*a* which holds the leading edge of the sheet S1, transferred by a gripper device of the swing arm shaft pregripper 31*f*, in a gripped state is provided on the feed-side transfer cylinder 32. The swing arm shaft pregripper 31*f* and feed-side transfer cylinder 32 constitute an upstream sheet conveyance device. Note that in the following description, the gripper device is formed by a plurality of grippers aligned in the cylinder axis direction with predetermined gaps between them.

A printing cylinder 33 (first cylinder) with a diameter three times that of the feed-side transfer cylinder 32 is opposed to the feed-side transfer cylinder 32 on the downstream side of the swing arm shaft pregripper 31*f* in the sheet conveyance direction to be in contact with the feed-side transfer cylinder 32, and is rotatably supported on the frame 3*a*. The printing cylinder 33 includes printing cylinder gripper devices 33*a*, 33*b*, and 33*c* which hold the leading edge of the sheet S1 upon receiving it from the gripper device 32*a* of the feed-side transfer cylinder 32, and support surfaces 33*d*, 33*e*, and 33*f* which are provided in correspondence with the printing cylinder gripper devices 33*a*, 33*b*, and 33*c*, and support the sheet S1. The printing cylinder 33 is implemented by a triple-diameter cylinder provided with three pairs of printing cylinder gripper devices 33*a*, 33*b*, and 33*c* and support surfaces 33*d*, 33*e*, and 33*f*. The printing cylinder gripper devices 33*a*, 33*b*, and 33*c* are provided at positions 120° out of phase with each other in the circumferential direction.

An inkjet nozzle portion 34 is opposed to the circumferential surface of the printing cylinder 33 on the downstream side of the contact portion of the printing cylinder 33 with the feed-side transfer cylinder 32 in the sheet conveyance direction.

The inkjet nozzle portion 34 includes a plurality of ink heads 34*a* to 34*d* (to be referred to as ink heads hereinafter) which are juxtaposed in the sheet conveyance direction along the circumferential surface of the printing cylinder 33, and store inks of different colors. Each of the ink heads 34*a* to 34*d* is oriented in a direction perpendicular to the circumferential surface of the printing cylinder 33. The ink heads 34*a* to 34*d* are arranged in proximity to the printing cylinder 33 to have small gaps with the sheet S1 having its leading edge sucked by the entire support surfaces 33*d*, 33*e*, and 33*f*. The printing cylinder 33 and inkjet nozzle portion 34 constitute a sheet printing device.

An ink drying lamp 35 is opposed to the printing cylinder 33. The ink drying lamp 35 serves as a drying device which is opposed to the printing cylinder 33 on the downstream side of a printing region 33K, printed by the inkjet nozzle portion 34 of the printing cylinder 33, in the sheet conveyance direction, and irradiates the sheet S1 with light such as infrared or ultraviolet rays to dry ink printed on the sheet S1. Note that drying includes applying thermal energy to the ink to evaporate the moisture of the ink, and curing the ink.

The printing cylinder 33 is arranged on the downstream side of the inkjet nozzle portion 34 in the sheet conveyance direction to be in contact with a delivery-side transfer cylinder 36 rotatably supported on the frame 3*a*. The delivery-side transfer cylinder 36 has a gripper device 36*a* which holds the leading edge of the sheet S1, conveyed by the printing cylinder 33, upon receiving it from the printing cylinder gripper devices 33*a*, 33*b*, and 33*c*.

Another delivery-side transfer cylinder 37 is arranged on the downstream side of the contact portion of the delivery-side transfer cylinder 36 with the printing cylinder 33 in the sheet conveyance direction to be in contact with the delivery-side transfer cylinder 36. The delivery-side transfer cylinder 37 is rotatably supported on the frame 3*a*. The delivery-side transfer cylinder 37 has a gripper device 37*a* (upstream gripper device) which receives and holds the leading edge of the sheet S1 conveyed by the delivery-side transfer cylinder 36.

A delivery cylinder 38 is arranged on the downstream side of the contact portion of the delivery-side transfer cylinder 37 with the delivery-side transfer cylinder 36 in the sheet conveyance direction to be in contact with the delivery-side transfer cylinder 37. The delivery cylinder 38 is rotatably supported on the frame 3*a*. The delivery cylinder 38 has a gripper device 38*a* (downstream gripper device) which receives and holds the leading edge of the sheet S1 conveyed by the delivery-side transfer cylinder 37.

A belt conveyor-shaped delivery belt 40 which conveys the sheet S1 is disposed below the delivery cylinder 38. A pile board 41 which stacks sheets S1 having undergone a digital printing process by the digital printing unit 3 is provided on the leading edge side of the delivery belt 40 in the sheet conveyance direction. The delivery cylinder 38, delivery belt 40, and pile board 41 constitute the sheet delivery device 4. Also, the path of the sheet S1 conveyed by the delivery cylinder 38 and delivery belt 40 constitutes a sheet discharge path.

A pre-reversal double-diameter cylinder 39 (second cylinder) is arranged on the downstream side of the contact portion of the delivery-side transfer cylinder 37 with the delivery cylinder 38 in the sheet conveyance direction. The pre-reversal double-diameter cylinder 39 serves as a pre-reversal transport cylinder and is rotatably supported on the frame 3*a*. The pre-reversal double-diameter cylinder 39 is implemented by a double-diameter cylinder with a diameter twice that of the delivery-side transfer cylinder 37, and receives and holds the leading edge of the sheet S1 conveyed by the delivery-side transfer cylinder 37.

Figure 2:
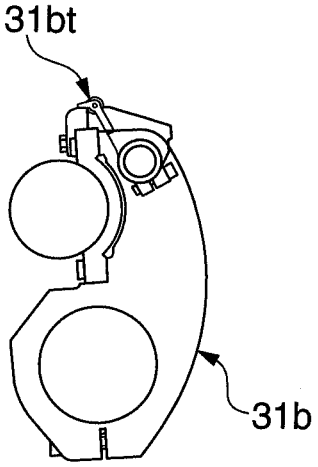
FIG. 2 is an enlarged side view of a swing arm shaft pregripper shown in FIG. 1.

A reversing swing arm shaft pregripper 31*b* having a reversing gripper device 31*bt* which receives and holds the trailing edge (rear edge) of the sheet S1 as its other edge is opposed to the pre-reversal double-diameter cylinder 39 on the downstream side of the contact portion of the pre-reversal double-diameter cylinder 39 with the delivery-side transfer cylinder 37 in the sheet conveyance direction, as shown in FIG. 2. The reversing swing arm shaft pregripper 31*b* is opposed to the printing cylinder 33 on the downstream side of the contact portion of the printing cylinder 33 with the delivery-side transfer cylinder 36 in the rotation direction of the printing cylinder 33, and on the upstream side of the contact portion of the printing cylinder 33 with the feed-side transfer cylinder 32 in the rotation direction of the printing cylinder 33. The reversing swing arm shaft pregripper 31*b* is supported on the frame 3*a* to be swingable between a reception position (a broken line in FIG. 1) at which it receives the trailing edge of the sheet S1 conveyed by the pre-reversal double-diameter cylinder 39, and a transfer position (a solid line in FIG. 1) at which it transfers by a gripping change the trailing edge of the sheet S1 to the printing cylinder gripper devices 33*a*, 33*b*, and 33*c* of the printing cylinder 33.

Note that the delivery-side transfer cylinders 36 and 37, pre-reversal double-diameter cylinder 39, and reversing swing arm shaft pregripper 31*b* constitute a sheet conveyance device 301 which conveys the sheet S1. The reversing gripper device and reversing swing arm shaft pregripper 31*b* constitute a sheet reversing portion which turns the sheet S1. The path of the sheet S1 conveyed by the delivery-side transfer cylinders 36 and 37, pre-reversal double-diameter cylinder 39, and reversing swing arm shaft pregripper 31*b* constitutes a sheet reversal path.

The gripper device 37*a* of the delivery-side transfer cylinder 37 is driven by a conveyance path switching cam mechanism and first switching device (both will be described later) to selectively transfer by a gripping change the sheet S1 between the gripper device 38*a* of the delivery cylinder 38 and a gripper device 39*a* of the pre-reversal double-diameter cylinder 39. Also, the gripper device 38*a* of the delivery cylinder 38 is driven by a conveyance path switching cam mechanism and second switching device (both will be described later) to selectively receive the leading edge of the sheet S1 conveyed by the delivery-side transfer cylinder 37. The gripper devices 37*a* and 38*a* constitute a conveyance path switching device 82 which switches the conveyance destination of the sheet S1 to the sheet delivery device 4 or reversing swing arm shaft pregripper 31*b*, that is, switches the conveyance destination of the sheet S1 to the sheet discharge path or the sheet reversal path.

Arrangement of Conveyance Path Switching Cam Mechanism

Figure 3:
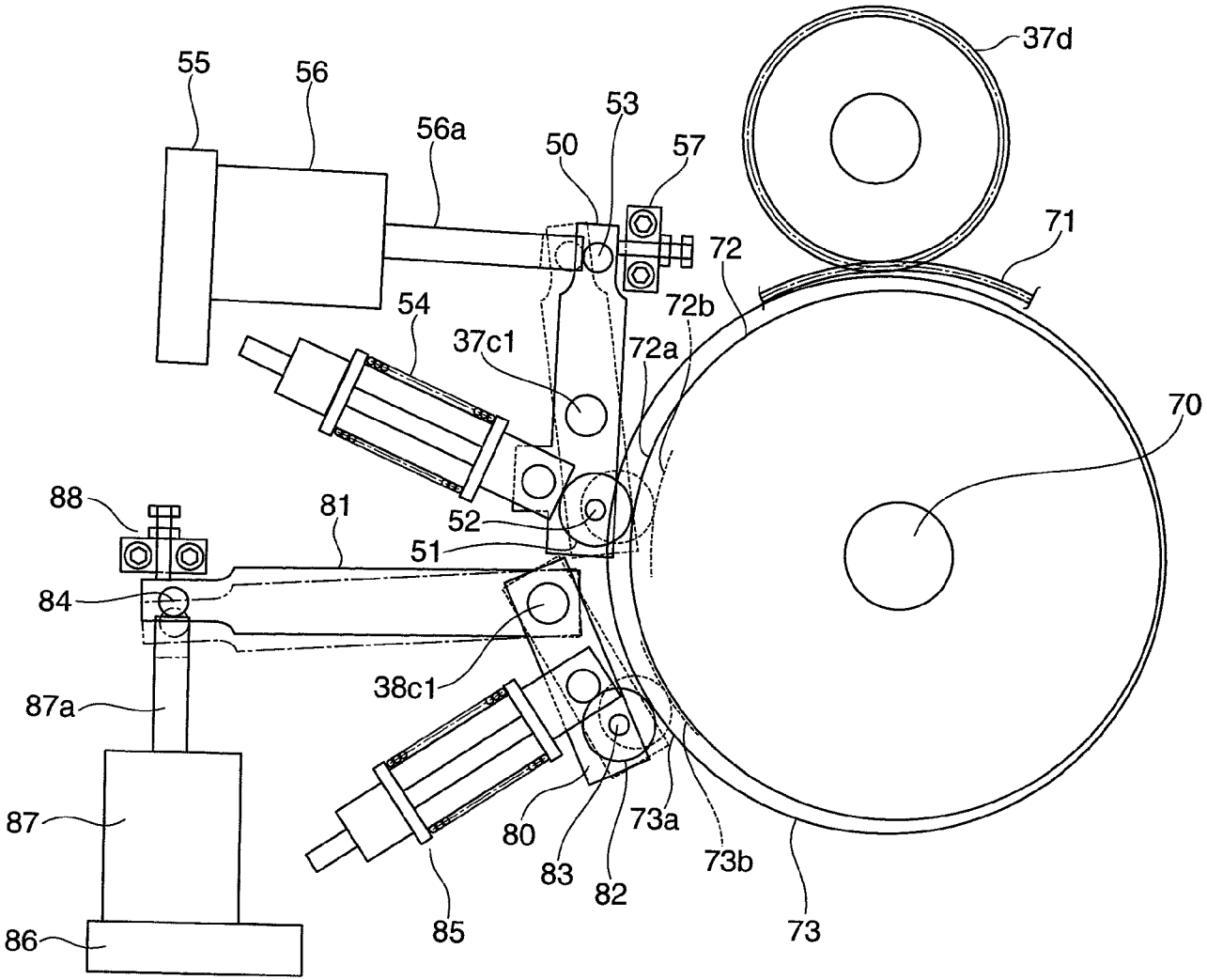
FIG. 3 is a side view showing the arrangement of a conveyance path switching cam mechanism.

A gear 71 which meshes with a gear 37*d* of a delivery-side transfer cylinder 37 is fixed to a shaft 70 rotatably supported on the frame 3*a*, as shown in FIG. 3. A first switching cam 72 and second switching cam 73 are fixed to the shaft 70. The first switching cam 72 has a large-diameter cam surface 72*a* and small-diameter cam surface 72*b*. The second switching cam 73 has a large-diameter cam surface 73*a* and small-diameter cam surface 73*b*.

Arrangement of First Switching Device

Figure 4:
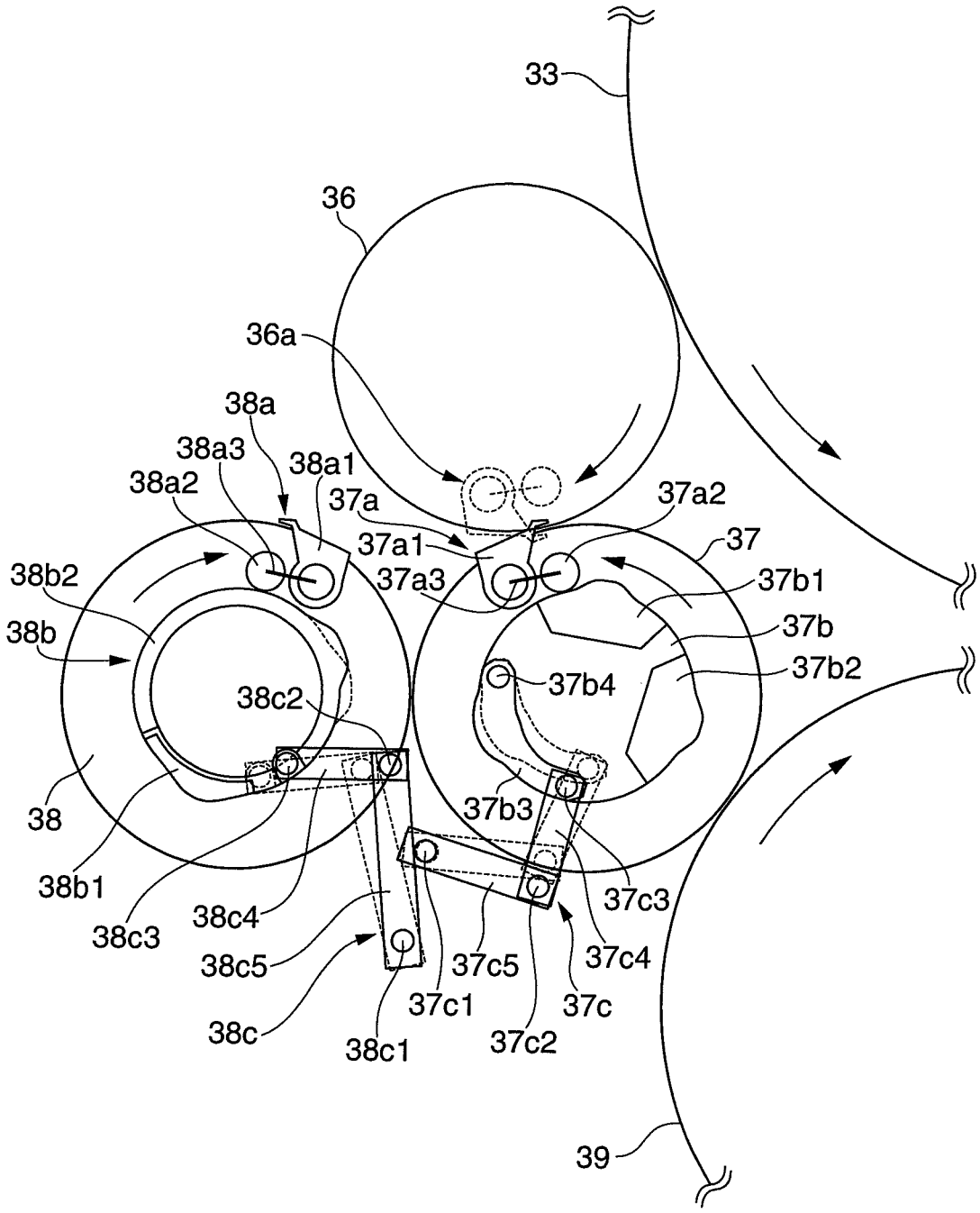
FIG. 4 is a side view showing a delivery-side sheet gripping mechanism in a second delivery-side transfer cylinder and sheet delivery cylinder.

A cam member 37*b* is provided on the frame 3*a* opposed to one end face of the delivery-side transfer cylinder 37, as shown in FIG. 4. The cam member 37*b* is formed by three partial cams: a first cam 37*b*1 fixed to the frame 3*a* near the contact portion with the delivery-side transfer cylinder 36, a second cam 37*b*2 fixed to the frame 3*a* near the contact portion with the pre-reversal double-diameter cylinder 39, and a third cam 37*b*3 (upstream cam) swingably provided on the frame 3*a*.

The third cam 37*b*3 has a proximal end pivotally supported on the frame 3*a* by a pivot shaft 37*b*4, and a free end to which an arm portion 37*c*4 is connected via a pin 37*c*3. An arm portion 37*c*5 is connected to the arm portion 37*c*4 via a pin 37*c*2, and a shaft 37*c*1 is fixed to the arm portion 37*c*5 to be pivotally supported on the frame 3*a*. The arm portions 37*c*4 and 37*c*5 and pin 37*c*2 constitute a link 37*c*.

A lever 50 is fixed to the shaft 37*c*1, as shown in FIG. 3. The lever 50 has a cam follower 51 which is pivotally, axially supported by a pin 52 at its one end and is in contact with the cam surfaces 72*a* and 72*b* of the first switching cam 72, and has a pin 53 fixed to its other end. The lever 50 has one end connected by pin coupling to the distal end of a spring gear 54 supported on the frame 3*a*. The spring gear 54 biases the lever 50 in the direction in which the cam follower 51 is pressed against the cam surfaces 72*a* and 72*b*.

The frame 3*a* is equipped with an air cylinder 56 serving as an actuator through a bracket 55, and the distal end of a rod 56*a* of the air cylinder 56 is opposed to the pin 53 of the lever 50. A stopper 57 with its distal end which abuts against the end face of the lever 50 on the side of the shaft 70 is fixed to the frame 3*a* on the opposite side of the pin 53 with respect to the air cylinder 56.

A cam follower 37*a*2 and the gripper shaft of a gripper 37*a*1 which constitutes the gripper device 37*a* of the delivery-side transfer cylinder 37 are connected to each other via a lever 37*a*3, as shown in FIG. 4. The cam follower 37*a*2 connected to the lever 37*a*3 is in contact with the circumferential surfaces of the first cam 37*b*1, second cam 37*b*2, and third cam 37*b*3. A biasing means of a torsion bar (not shown) applies a biasing force to the cam follower 37*a*2 in the direction to press it against the circumferential surfaces of the cams 37*b*1, 37*b*2, and 37*b*3.

Arrangement of Second Switching Device

A cam member 38*b* is provided on the frame 3*a* opposed to one end face of the delivery cylinder 38, as shown in FIG. 4. The cam member 38*b* is formed by a first cam 38*b*1 fixed to the frame 3*a* near the portion opposed to the delivery belt 40, and a second cam 38*b*2 (downstream cam) which is provided near the contact portion with the delivery-side transfer cylinder 37, and pivotally supported around the shaft of the delivery cylinder 38.

An arm portion 38*c*4 is connected to the second cam 38*b*2 via a pin 38*c*3, while an arm portion 38*c*5 is connected to the arm portion 38*c*4 via a pin 38*c*2. The arm portion 38*c*5 is fixed to a shaft 38*c*1 pivotally supported on the frame 3*a*. The arm portions 38*c*4 and 38*c*5 and pin 38*c*2 constitute a link 38*c*.

Levers 80 and 81 are fixed to the shaft 38*c*1 to be integrally swingable, as shown in FIG. 3. A cam follower 82 which is in contact with the cam surfaces 73*a* and 73*b* of the second switching cam 73 is pivotally supported by a pin 83, and has one end connected by pin coupling to the distal end of a spring gear 85 supported on the frame 3*a*. The spring gear 85 biases the lever 80 to which a pin 84 is fixed in the direction in which the conveyance path switching device 82 is pressed against the cam surfaces 73*a* and 73*b*.

An air cylinder 87 serving as an actuator is attached to the frame 3*a* through a bracket 86. The distal end of a rod 87*a* of the air cylinder 87 is opposed to the pin 84 of the lever 81. A stopper 88 with its distal end which abuts against one end face of the lever 81 is fixed to the frame 3*a* on the opposite side of the pin 84 with respect to the air cylinder 87.

A cam follower 38*a*2 and the gripper shaft of a gripper 38*a*1 which constitutes the gripper device 38*a* of the delivery cylinder 38 are connected to each other via a lever 38*a*3, as shown in FIG. 4. The cam follower 38*a*2 connected to the lever 38*a*3 is in contact with the circumferential surfaces of the first cams 38*b*1 and 38*b*2. A biasing means of a torsion bar (not shown) applies a biasing force to the cam follower 38*a*2 in the direction to press it against the circumferential surfaces of the cams 38*b*1 and 38*b*2.

Feed-Side Sheet Gripping Change Mechanism

A feed-side sheet gripping change mechanism which transfers the sheet S1 by a gripping change between the gripper device 32*a* of the feed-side transfer cylinder 32, and the gripper devices 33*a*, 33*b*, and 33*c* of the printing cylinder 33 will be described.

Arrangement of Gripping Change Mechanism of Feed-Side Transfer Cylinder

Figure 5:
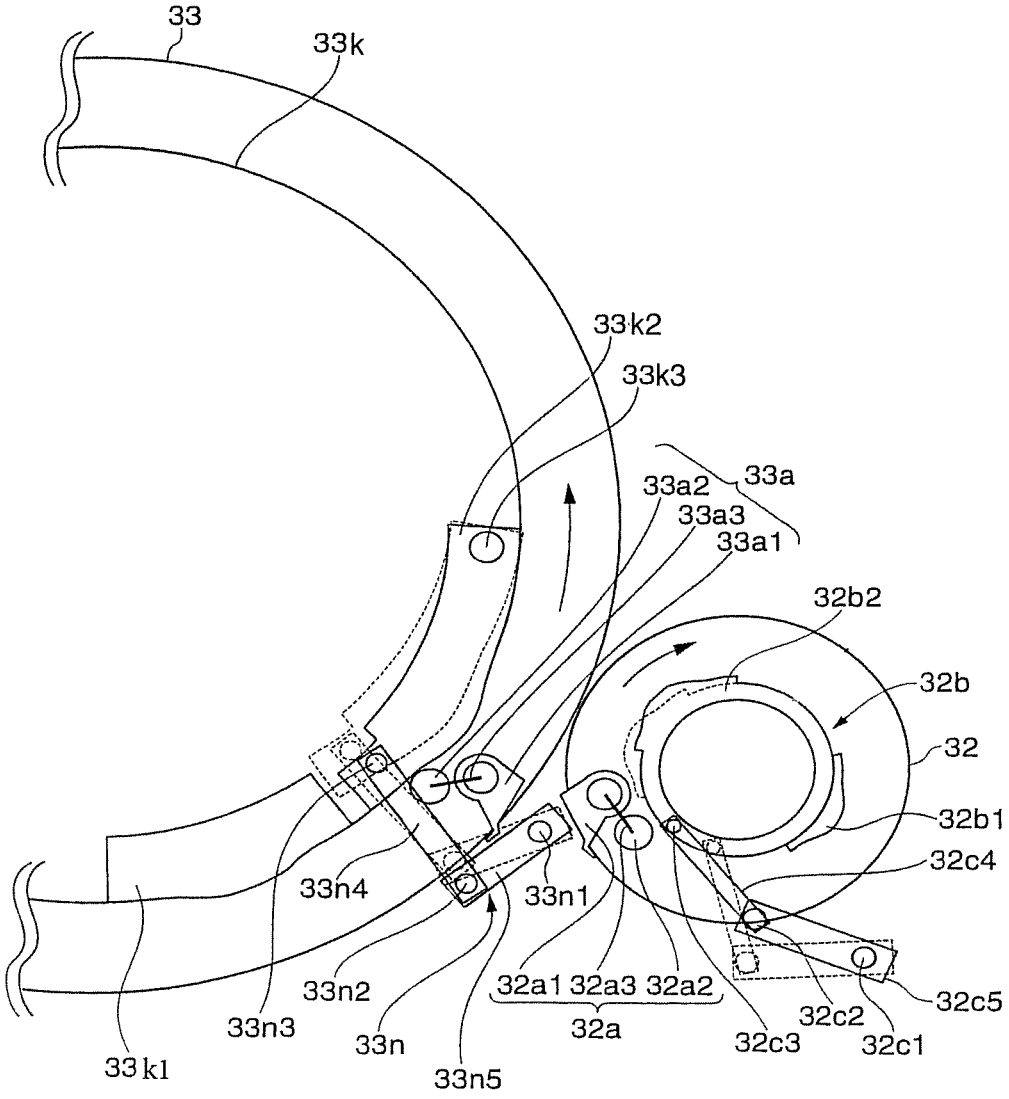
FIG. 5 is a side view showing a delivery-side sheet gripping mechanism and feed-side sheet gripping mechanism in a feed-side transfer cylinder and printing cylinder.

A cam member 32*b* is provided on the frame 3*a* opposed to one end face of the feed-side transfer cylinder 32, as shown in FIG. 5. The cam member 32*b* is formed by a first cam 32*b*1 fixed to the frame 3*a* near the portion opposed to the swing arm shaft pregripper 31*f*, and a ring-shaped second cam 32*b*2 which is pivotally supported around the shaft of the feed-side transfer cylinder 32 to set a large-diameter portion near the contact portion with the printing cylinder 33.

An arm portion 32*c*4 is connected to the second cam 32*b*2 via a pin 32*c*3, while an arm portion 32*c*5 is connected to the arm portion 32*c*4 via a pin 32*c*2. The arm portion 32*c*5 is fixed to a shaft 32*c*1 pivotally supported on the frame 3*a*. A feed-side first switching device 106 (FIG. 7) which pivots the shaft 32*c*1 is connected to the shaft 32*c*1.

A cam follower 32*a*2 and the gripper shaft of a gripper 32*a*1 which constitutes the gripper device 32*a* of the feed-side transfer cylinder 32 are connected to each other via a lever 32*a*3. The cam follower 32*a*2 connected to the lever 32*a*3 is in contact with the circumferential surfaces of a first cam 32*b*1 and a second cam 38*b*2. A biasing means of a torsion bar (not shown) applies a biasing force to the cam follower 32*a*2 in the direction to press it against the circumferential surfaces of the first cam 32*b*1 and second cam 32*b*2.

Arrangement of Gripping Change Mechanism of Printing Cylinder

A first cam 33*k*1 and a second cam 33*k*2 are provided on the frame 3*a* opposed to one end face of the printing cylinder 33. The first cam 33*k*1 is fixed to the frame 3*a* near the position at which it is opposed to the reversing swing arm shaft pregripper 31*b*, and the second cam 33*k*2 is movably provided on the frame 3*a* near the contact portion with the feed-side transfer cylinder 32.

The proximal end of the second cam 33*k*2 is pivotally supported on the frame 3*a* by a swing shaft 33*k*3. The free end of the second cam 33*k*2 is connected to an arm portion 33*n*4 via a pin 33*n*3.

An arm portion 33*n*5 is connected to the arm portion 33*n*4 via a pin 33*n*2, and a shaft 33*n*1 is fixed to the arm portion 33*n*5 to be pivotally supported on the frame 3*a*. A feed-side second switching device 107 (FIG. 7) which pivots the shaft 33*n*1 is connected to the shaft 33*n*1. The arm portions 33*n*4 and 33*n*5 and pin 33*n*2 constitute a link 33*n*.

A cam follower 33*a*2 and the gripper shaft of a gripper 33*a*1 which constitutes the gripper device 33*a* of the printing cylinder 33 are connected to each other via a lever 33*a*3. The cam follower 33*a*2 connected to the lever 33*a*3 is in contact with the circumferential surfaces of a cam member 33*k*, the first cam 33*k*1, and the second cam 33*k*2. A biasing means of a torsion bar (not shown) applies a biasing force to the cam follower 33*a*2 in the direction to press it against the circumferential surfaces of the first cam 33*k*1 and second cam 33*k*2.

Gripping Change Mechanism of Pre-Reversal Double-Diameter Cylinder

Figure 6:
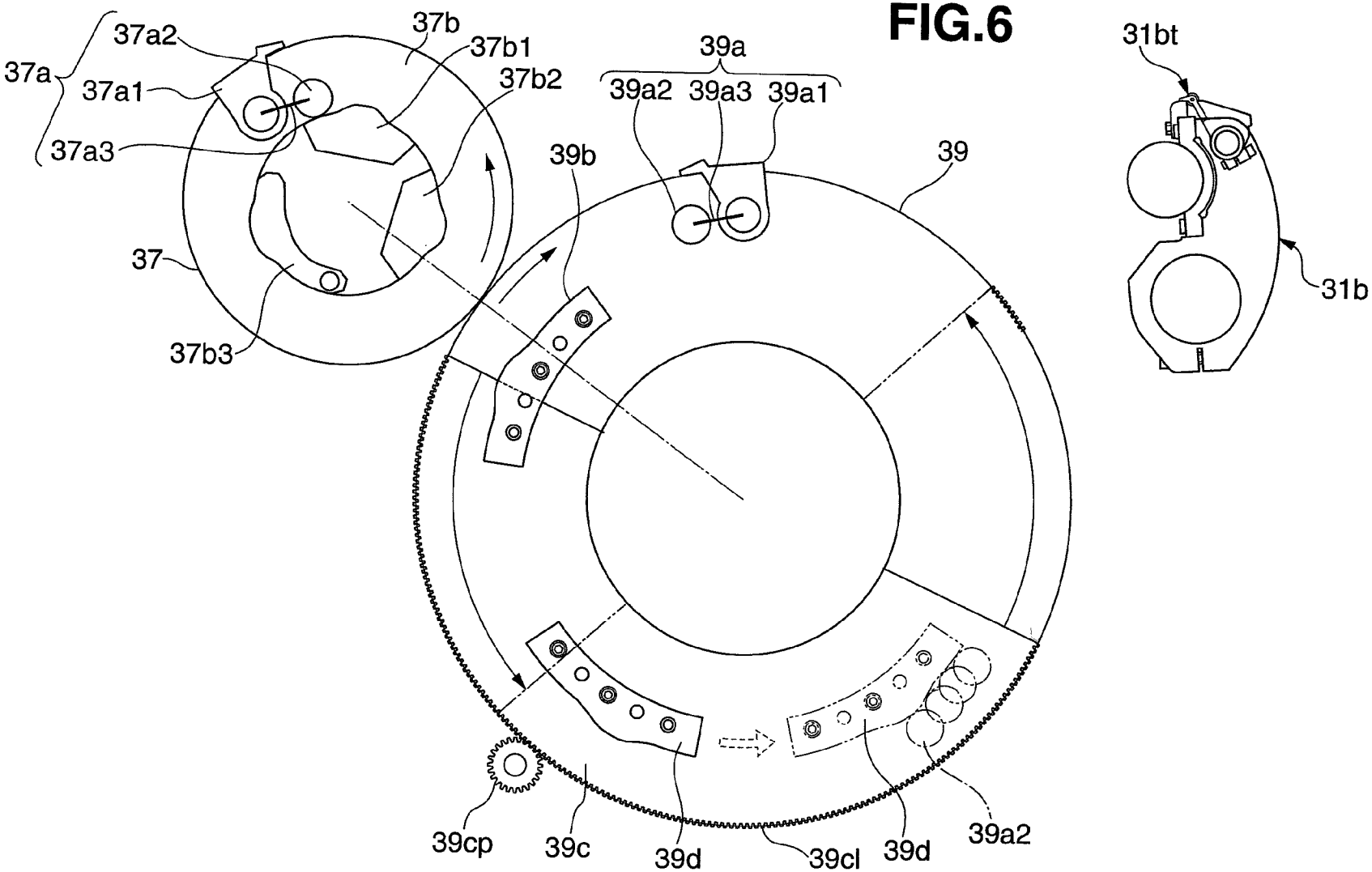
FIG. 6 is a side view of a gripping mechanism corresponding to the sheet size in a pre-reversal double-diameter cylinder.

A fixed cam 39*b* is fixed to the frame 3*a*, opposed to one end face of the pre-reversal double-diameter cylinder 39, near the position at which it is opposed to the delivery-side transfer cylinder 37, and a movable cam 39*d* is movably provided on the frame 3*a*, as shown in FIG. 6.

A semicircular disk-shaped segment gear 39*c* to which the movable cam 39*d* is fixed is supported by the pre-reversal double-diameter cylinder 39 to be pivotal about the shaft of the pre-reversal double-diameter cylinder 39. A pinion 39*cp* connected to the sheet size adjusting motor 108 (FIG. 7) meshes with teeth 39*c*1 of the segment gear 39*c*.

A cam follower 39*a*2 and the gripper shaft of a gripper 39*a*1 which constitutes the gripper device 39*a* of the pre-reversal double-diameter cylinder 39 are connected to each other via a lever 39*a*3. The cam follower 39*a*2 is in contact with the circumferential surfaces of the fixed cam 39*b* and movable cam 39*d*. A biasing means of a torsion bar (not shown) applies a biasing force to the cam follower 39*a*2 in the direction to press it against the circumferential surfaces of the fixed cam 39*b* and movable cam 39*d*.

Configuration of Control System

Figure 7:
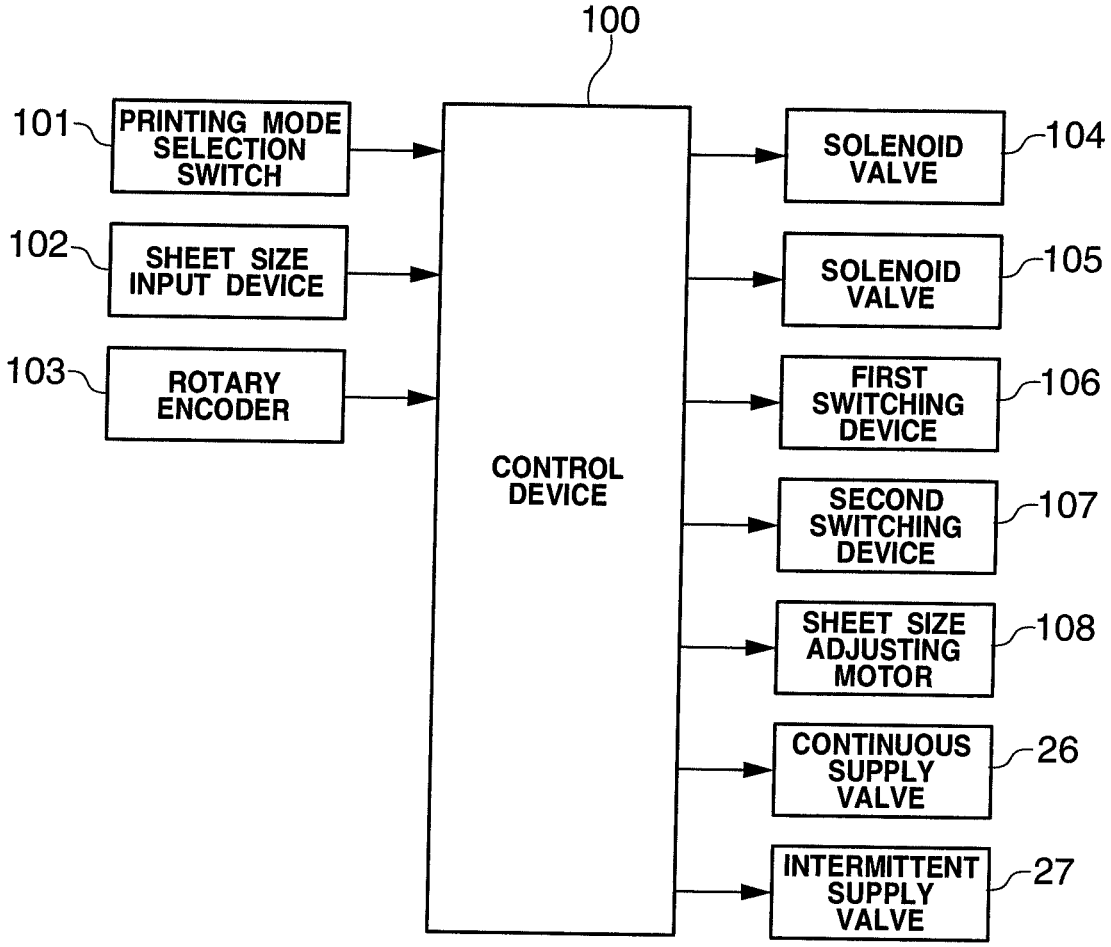
FIG. 7 is a block diagram showing the configuration of a control system for the digital printing apparatus.

The configuration of the control system for the digital printing apparatus 1 will be described next. A control device 100 implemented by a CPU (Central Processing Unit) is connected to a printing mode selection switch 101 which selects a single-sided printing mode or a double-sided printing mode, a sheet size input device 102 which receives a sheet size input by the operator, a rotary encoder 103 serving as a phase detection device, a solenoid valve 104 which switches the operation of the air cylinder 56 (FIG. 3), a solenoid valve 105 which switches the operation of the air cylinder 87 (FIG. 3), a feed-side first switching device 106 which switches the position of the second cam 32*b*2 of the feed-side transfer cylinder 32, a feed-side second switching device 107 which switches the position of the second cam 33*k*2 of the printing cylinder 33, a sheet size adjusting motor 108, the continuous supply valve 26 which supplies sheets to the digital printing unit 3 one by one at a first period, and the intermittent supply valve 27 which supplies sheets to the digital printing unit 3 one by one at a second period twice the first period, as shown in FIG. 7. The air cylinder 56 (FIG. 3) and solenoid valve 104 constitute an upstream cam switching device, while the air cylinder 87 (FIG. 3) and solenoid valve 105 constitute a downstream cam switching device.

Printing Operation of Digital Printing Apparatus

The printing operation of the digital printing apparatus 1 configured as mentioned above will be described separately for the case wherein the single-sided printing mode is selected and that wherein the double-sided printing mode is selected.

Printing Operation in Single-Sided Printing Mode

Prior to the operation of the digital printing apparatus 1, first, the operator operates the printing mode selection switch 101 (FIG. 7) to select the single-sided printing mode. The control device 100 actuates the continuous supply valve 26 based on the single-sided printing mode selected by the printing mode selection switch 101. With this operation, the suction ports 23*a* and 23*b* suck and supply the sheets S1 onto the feeder board FB one by one, as shown in FIG. 1.

As the continuous supply valve 26 operates, suction from the suction ports 23*a* and 23*b* is performed by a negative pressure from the negative pressure source 25 at each timing (first period) at which the same number of sheets S1 as the number of printing cylinder gripper devices 33*a*, 33*b*, and 33*c* of the printing cylinder 33 are supplied during 360° rotation of the printing cylinder 33, that is, at each timing (period) at which the printing cylinder gripper devices 33*a*, 33*b*, and 33*c* in the printing cylinder 33, and the gripper device 32*a* of the feed-side transfer cylinder 32 are opposed to each other. In this manner, supply of the sheet S1 so that all the gripper devices 33*a*, 33*b*, and 33*c* of the printing cylinder 33 grip the sheet S1 will be referred to as continuous sheet feed hereinafter. Upon actuation of the continuous supply valve 26, the sucker device 23 supplies the sheet S1 onto the feeder board FB at the first period.

The leading edge of the sheet S1 conveyed by the feeder board FB is held by the gripper device of the swing arm shaft pregripper 31*f*, and the sheet S1 is conveyed onto the feed-side transfer cylinder 32 upon a swing of the swing arm shaft pregripper 31*f*. The leading edge of the sheet S1 is transferred by a gripping change to the gripper device 32*a* of the feed-side transfer cylinder 32.

In selecting the single-sided printing mode, the control device 100 controls the first switching device 106 to set the second cam 32*b*2 of the feed-side transfer cylinder 32 at a gripping change position (a solid line in FIG. 5). Also, the control device 100 controls the second switching device 107 to set the second cam 33*k*2 of the printing cylinder 33 at a gripping change position (a solid line in FIG. 5). Note that the gripping change positions of the second cam 32*b*2 of the feed-side transfer cylinder 32, and the second cam 33*k*2 of the printing cylinder 33 are the positions through which the cam followers 32*a*2 and 33*a*2 of the two cylinders 32 and 33 pass while engaging with the second cams 32*b*2 and 33*k*2, at the transfer timings at which the grippers 32*a*1 and 33*a*1 of the two cylinders 32 and 33 are opposed to each other.

When the sheet S1 passes through the contact portion between the feed-side transfer cylinder 32 and the printing cylinder 33, the cam follower 33*a*2 of the gripper device 33*a* of the printing cylinder 33 passes along the cam surface of the second cam 33*k*2, so the gripper 33*a*1 opens/closes through the lever 33*a*3, as shown in FIG. 5. As the gripper 33*a*1 opens/closes, the leading edge of the sheet S1 held by the gripper 32*a*1 of the feed-side transfer cylinder 32 is also transferred by a gripping change by the gripper 33*a*1 of the gripper device 33*a* of the printing cylinder 33. That is, the leading edge of the sheet S1 is held by both the gripper device 32*a* of the feed-side transfer cylinder 32, and the gripper device 33*a* of the printing cylinder 33.

The cam follower 32*a*2 of the feed-side transfer cylinder 32 passes through the cam surface of the second cam 32*b*2 while engaging with it, so the gripper 32*a*1 opens through the lever 32*a*3 to cancel holding of the sheet S1. With this operation, the sheet S1 is transferred by a gripping change from the gripper device 32*a* of the feed-side transfer cylinder 32 to the gripper device 33*a* of the printing cylinder 33. The gripper 32*a*1 closes after the cam follower 32*a*2 passes through the cam surface of the second cam 32*b*2.

The sheet S1 held by the gripper device 33*a* of the printing cylinder 33 passes between the printing cylinder 33 and the inkjet nozzle heads 34*a* to 34*d* of the inkjet nozzle portion 34 while being conveyed with rotation of the printing cylinder 33. At this time, a digital printing process is performed on the obverse surface (one surface) of the sheet S1 as minute droplets of ink discharged from the inkjet nozzle heads 34*a* to 34*d* are adhered onto this surface.

Figure 8A:
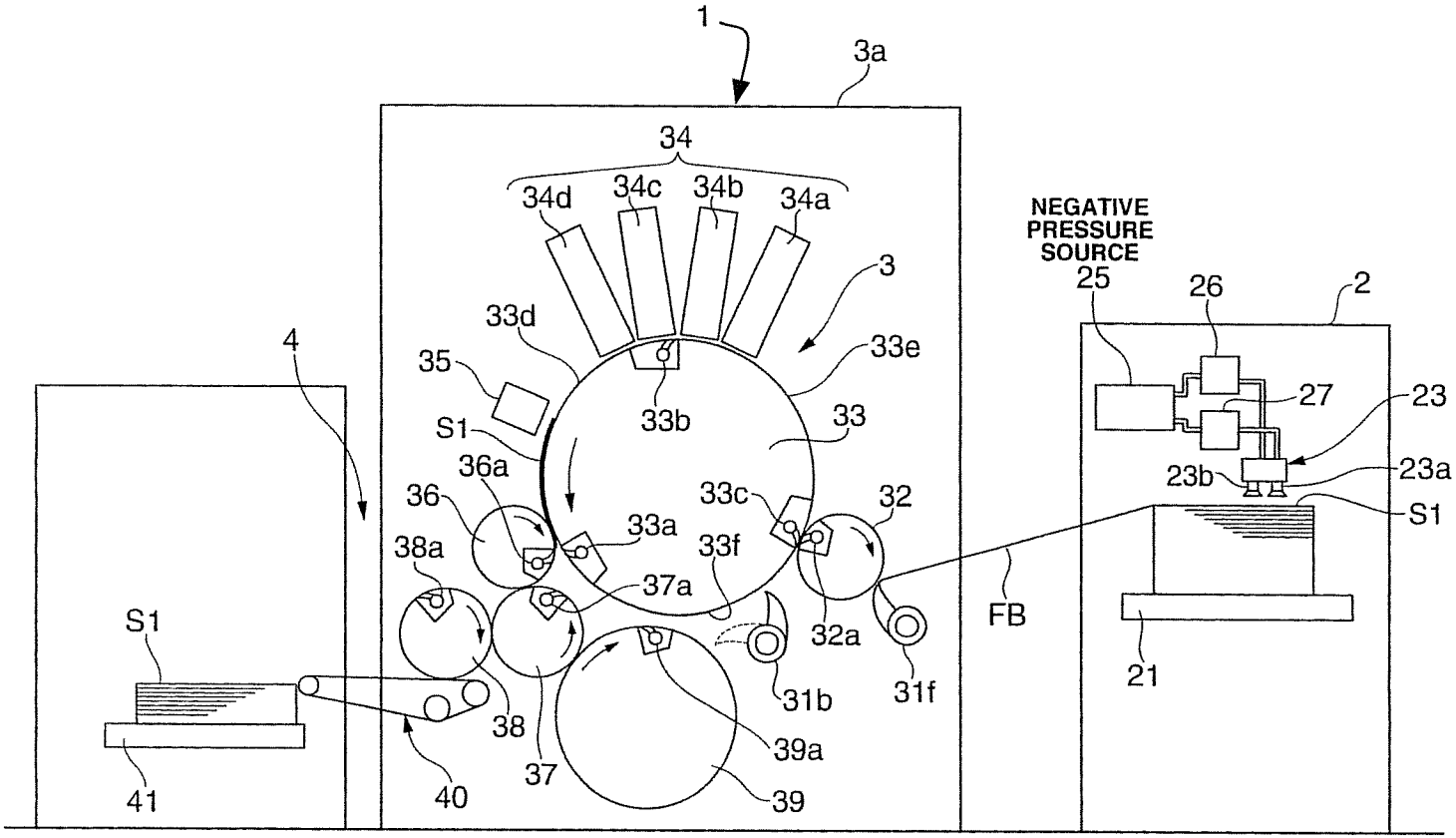
FIGS. 8A to 8E are side views showing printing processes (1) to (5) in the digital printing apparatus.

When the sheet S1 having undergone a digital printing process on its obverse surface passes between the printing cylinder 33 and the ink drying lamp 35, ink adhered on the sheet S1 is dried or cured with light emitted by the ink drying lamp 35, and is conveyed onto the delivery-side transfer cylinder 36. When the sheet S1 passes through the contact portion between the printing cylinder 33 and the delivery-side transfer cylinder 36, the leading edge of the sheet S1 is transferred by a gripping change from the gripper device 33*a* of the printing cylinder 33 to the gripper device 36*a* of the delivery-side transfer cylinder 36, as shown in FIG. 8A.

When the sheet S1 passes through the contact portion between the delivery-side transfer cylinders 36 and 37, the cam follower 37*a*2 of the gripper device 37*a* of the delivery-side transfer cylinder 37 passes through the cam surface of the first cam 37*b*1 of the cam member 37*b*, so the gripper 37*a*1 opens/closes through the lever 37*a*3. With this operation, the leading edge of the sheet S1 held by the gripper device 36*a* of the delivery-side transfer cylinder 36 is gripped by the gripper 37*a*1 of the gripper device 37*a* of the delivery-side transfer cylinder 37. The gripper device 36*a* of the delivery-side transfer cylinder 36 opens to cancel holding of the sheet S1. With this operation, the sheet S1 is transferred by a gripping change from the gripper device 36*a* of the delivery-side transfer cylinder 36 to the gripper device 37*a* of the delivery-side transfer cylinder 37.

In selecting the single-sided printing mode, the control device 100 controls the solenoid valve 104 to extend the rod 56*a* of the air cylinder 56. As the rod 56*a* of the air cylinder 56 extends, the distal end of the rod 56*a* abuts against the pin 53 of the lever 50. As the rod 56*a* further extends, the lever 50 swings against the biasing force of the spring gear 54 and abuts against the stopper 57. With this operation, the lever 50 is set at a retreat position (a solid line in FIG. 3). At the retreat position, the cam follower 51 slightly separates from the cam surfaces 72*a* and 72*b* of the first switching cam 72, and is not in contact with the cam surfaces 72*a* and 72*b*.

As the lever 50 swings to the retreat position, the shaft 37*c*1 pivots. As the shaft 37*c*1 pivots, the arm portions 37*c*4 and 37*c*5 of the link 37*c* pivot to set the third cam 37*b*3 at an actuation position (a solid line in FIG. 3).

At the same time, the control device 100 controls the solenoid valve 105 to extend the rod 87*a* of the air cylinder 87. As the rod 87*a* extends, the distal end of the rod 87*a* abuts against the pin 84 of the lever 81. As the rod 87*a* further extends, the lever 81 swings against the biasing force of the spring gear 85 and abuts against the stopper 88. With this operation, the lever 81 is set at an actuation position (a solid line in FIG. 3), the lever 80 is set at a retreat position (a solid line in FIG. 3) through the shaft 38*c*1. At the retreat position, the cam follower 82 slightly separates from the cam surfaces 73*a* and 73*b* of the second switching cam 73, and is not in contact with the cam surfaces 73*a* and 73*b*.

As the lever 80 swings to the retreat position, the shaft 38*c*1 pivots. As the shaft 38*c*1 pivots, the arm portions 38*c*4 and 38*c*5 of the link 38*c* pivot to set the second cam 38*b*2 at an actuation position (a solid line in FIG. 4).

When the gripper device 37*a* of the delivery-side transfer cylinder 37 which holds the leading edge of the sheet S1 reaches the contact portion with the delivery cylinder 38, the cam follower 38*a*2 of the gripper device 38*a* of the delivery cylinder 38 passes through the cam surface of the second cam 38*b*2 to open/close the gripper 38*a*1. With this operation, the leading edge of the sheet S1 held by the gripper device 37*a* of the delivery-side transfer cylinder 37 is gripped by the gripper 38*a*1 of the gripper device 38*a* of the delivery cylinder 38. At this time, the leading edge of the sheet S1 is held by both the gripper device 37*a* of the delivery-side transfer cylinder 37, and the gripper device 38*a* of the delivery cylinder 38.

When the cam follower 37*a*2 of the delivery-side transfer cylinder 37 passes along the cam surface of the third cam 37*b*3 set at a position indicated by a solid line, the gripper 37*a*1 opens through the lever 37*a*3 to cancel holding of the sheet S1 by the gripper 37*a*1. When the cam follower 37*a*2 then passes through the cam surface of the third cam 37*b*3, the gripper 37*a*1 closes without gripping the sheet S1. With this operation, the sheet S1 is transferred by a gripping change from the gripper device 37*a* of the delivery-side transfer cylinder 37 to the gripper device 38*a* of the delivery cylinder 38.

The delivery cylinder 38 rotates while holding the leading edge of the sheet S1 by the gripper device 38*a*. When the cam follower 38*a*2 of the delivery cylinder 38 passes along the cam surface of the first cam 38*b*1, the gripper 38*a*1 opens through the lever 38*a*3 to cancel holding of the sheet S1, and the sheet S1 is mounted on the delivery belt 40. When the cam follower 38*a*2 then passes through the cam surface of the first cam 38*b*1, the gripper 38*a*1 closes without gripping the sheet S1. With this operation, the sheet S1 is conveyed from the delivery cylinder 38 onto the delivery belt 40.

The sheet S1 mounted on the delivery belt 40 is conveyed as it travels, and the sheet S1 having undergone a digital printing process only on its one surface (obverse surface) is discharged onto the pile board 41 of the sheet delivery device 4.

Printing Operation in Double-Sided Printing Mode

The double-sided printing mode is selected by operating the printing mode selection switch 101 by the operator. Also, the size of the sheet S1 is input to the sheet size input device 102 by the operator. The control device 100 actuates the continuous supply valve 26 based on the double-sided printing mode selected by the printing mode selection switch 101. With this operation, the suction ports 23*a* and 23*b* suck and supply the sheets S1 on the pile board 21 onto the feeder board FB one by one.

As the intermittent supply valve 27 operates, suction from the suction ports 23*a* and 23*b* by a negative pressure from the negative pressure source 25, and the stop of suction are alternately repeated at the alternate sheet supply timing (second period) for the continuous supply timing, that is, the timing at which the gripper devices 33*a*, 33*b*, and 33*c* in the printing cylinder 33, and the gripper device 32*a* of the feed-side transfer cylinder 32 are opposed to each other. The second period of intermittent supply becomes a period twice the first period of continuous supply. In this manner, supply of the sheet S1 so that the gripper devices 33*a*, 33*b*, and 33*c* of the printing cylinder 33 alternately grip the sheet S1 will be referred to as intermittent sheet feed hereinafter. As the intermittent supply valve 27 is actuated, the sucker device 23 supplies the sheet S1 onto the feeder board FB at the second period.

The sheet S1 conveyed by the feeder board FB is transferred onto the feed-side transfer cylinder 32 through the swing arm shaft pregripper 31*f*, as in the selection of the single-sided printing mode. Note that the sheet S1 is supplied at the second period, so the feed-side transfer cylinder 32 is gripped and conveyed every other 360° rotation operation.

In selecting the double-sided printing mode, the control device 100 controls the first switching device 106 to alternately set the second cam 32*b*2 of the feed-side transfer cylinder 32 at a gripping change position (a solid line in FIG. 5) and a retreat position (a broken line in FIG. 5) for each 360° rotation operation of the feed-side transfer cylinder 32. The control device 100 also controls the second switching device 107 to alternately set the second cam 33*k*2 of the printing cylinder 33 at a gripping change position (a solid line in FIG. 5) and a retreat position (a broken line in FIG. 5) at the same timing as the second cam 32*b*2 of the feed-side transfer cylinder 32. The control device 100 switches the positions of the second cams 32*b*2 and 33*k*2 by the first switching device 106 and second switching device 107 based on a phase signal from the rotary encoder 103.

With this operation, the second cams 32*b*2 and 33*k*2 of the feed-side transfer cylinder 32 and printing cylinder 33 are set at the timing (second period) at which the gripper device 32*a* of the feed-side transfer cylinder 32 grips the sheet S1. On the other hand, the second cams 32*b*2 and 33*k*2 of the feed-side transfer cylinder 32 and printing cylinder 33 are set at retreat positions at the timing at which the gripper device 32*a* does not grip the sheet S1. Note that the retreat position of the second cam 32*b*2 of the gripper device 32*a* of the feed-side transfer cylinder 32 is the position through which the cam follower 32*a*2 of the gripper device 32*a* of the feed-side transfer cylinder 32 passes through the second cam 32*b*2 while engaging with it, before the transfer timing at which the gripper 32*a*1 of the gripper device 32*a* of the feed-side transfer cylinder 32 is opposed to the gripper 33*a*1 of the gripper device 33*a* of the printing cylinder 33. The retreat position of the second cam 33*k*2 of the printing cylinder 33 is the position through which the cam follower 33*a*2 of the gripper device 33*a* of the printing cylinder 33 passes through the second cam 33*k*2 in a non-contact state.

When the gripper device 32*a* of the feed-side transfer cylinder 32 grips the sheet S1, the cam followers 32*a*2 and 33*a*2 of the feed-side transfer cylinder 32 and printing cylinder 33 pass through the cam surfaces of the second cams 32*b*2 and 33*k*2 set at griping change positions past the cam followers 32*a*2 and 33*a*2 to open/close the grippers 32*a*1 and 33*a*1 of the two cylinders to transfer the sheet S1 by a gripping change from the feed-side transfer cylinder 32 onto the printing cylinder 33, as in the single-sided printing mode.

On the other hand, when the gripper device 32*a* of the feed-side transfer cylinder 32 grips no sheet S1, the cam follower 32*a*2 of the gripper device 32*a* engages with the second cam 32*b*2 set at a retreat position to open the gripper 32*a*1 at a timing before the transfer timing. With this operation, the gripper 32*a*1 is opposed to the gripper 33*a*1 of the printing cylinder 33 and passes in an open state. Also, since the cam follower 33*a*2 of the gripper device 33*a* of the printing cylinder 33 is not in contact with the second cam 33*k*2, the gripper 33*a*1 is opposed to the gripper 33*a*1 of the printing cylinder 33 and passes in a closed state. That is, the gripper 32*a*1 of the gripper device 32*a* of the feed-side transfer cylinder 32, and the gripper 33*a*1 of the gripper device 33*a* of the printing cylinder 33 pass through the contact portion between the two cylinders in open and closed states, respectively.

Figure 8B:
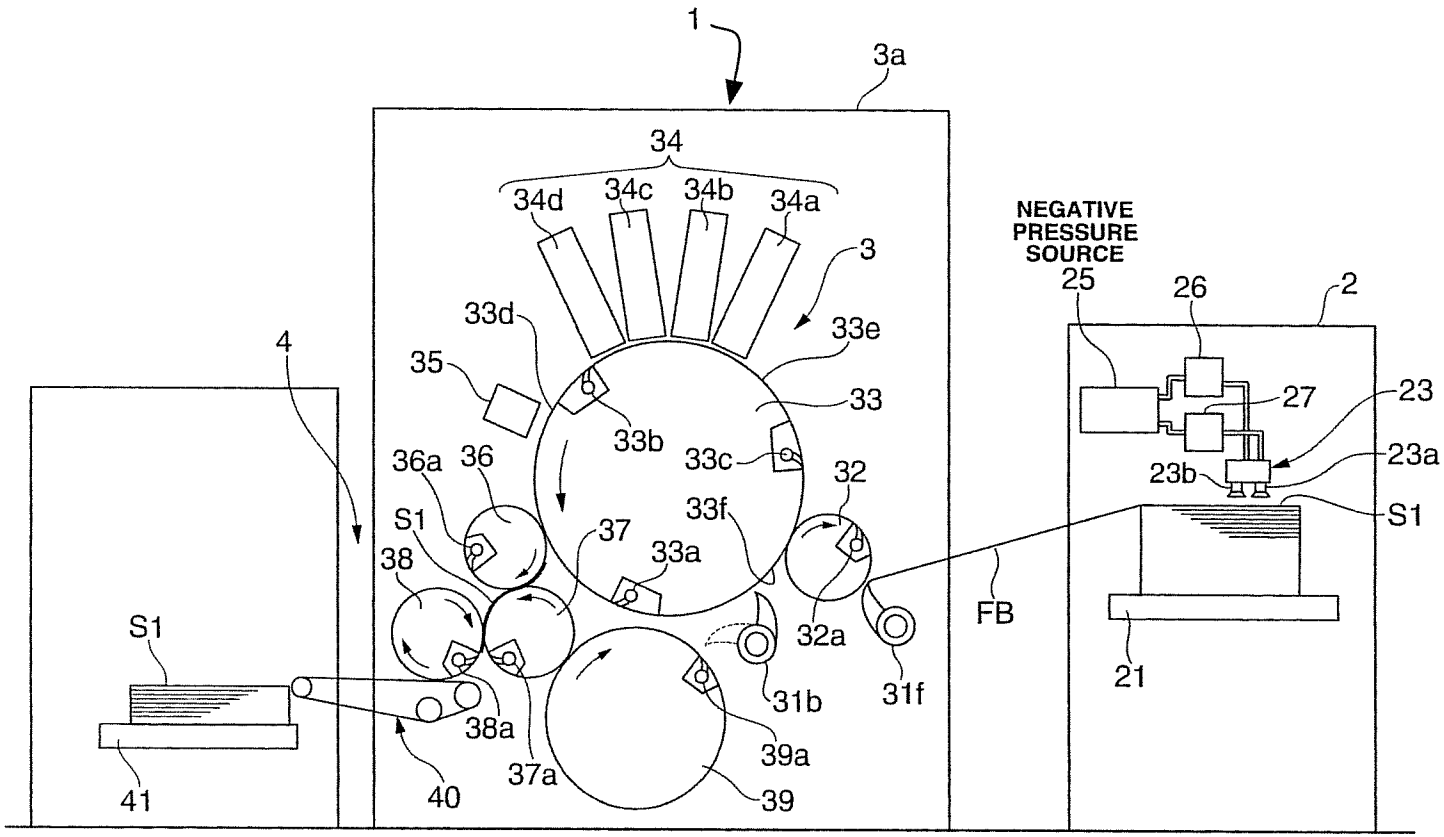

When the sheet S1 held by the gripper device 33*a* of the printing cylinder 33 passes between the printing cylinder 33 and the inkjet nozzle heads 34*a* to 34*d* of the inkjet nozzle portion 34, a digital printing process is performed on the obverse surface of the sheet S1, as in the selection of the single-sided printing mode. Ink adhered on the obverse surface of the sheet S1 having undergone a digital printing process is dried or cured by the ink drying lamp 35, and the sheet S1 is conveyed onto the delivery-side transfer cylinder 37 through the delivery-side transfer cylinder 36, as shown in FIG. 8B.

In selecting the double-sided printing mode, the control device 100 controls the solenoid valve 104 to retract the rod 56*a* of the air cylinder 56. Upon retraction of the rod 56*a*, the distal end of the rod 56*a* separates from the pin 53 of the lever 50, and the lever 50 swings against the biasing force of the spring gear 54, so the lever 50 separates from the stopper 57. With this operation, the cam follower 51 is pressed against the cam surfaces 72*a* and 72*b* of the first switching cam 72 using the biasing force of the spring gear 54.

At the same time, the control device 100 controls the solenoid valve 105 to retract the rod 87*a* of the air cylinder 87. Upon retraction of the rod 87*a*, the distal end of the rod 87*a* separates from the pin 84 of the lever 81, and the levers 81 and 80 integrally swing using the biasing force of the spring gear 85, so the lever 81 separates from the stopper 88. With this operation, the conveyance path switching device 82 is pressed against the cam surfaces 73*a* and 73*b* of the second switching cam 73 using the biasing force of the spring gear 85.

The first switching cam 72 and second switching cam 73 rotate through the gears 37*d* and 71 and shaft 70 with rotation of the delivery-side transfer cylinder 37. As the first switching cam 72 rotates while the cam follower 51 is pressed against the cam surfaces 72*a* and 72*b* of the first switching cam 72, the lever 50 swings along the cam surfaces 72*a* and 72*b* of the first switching cam 72 to pivot the shaft 37*c*1. As the shaft 37*c*1 pivots, the arm portions 37*c*4 and 37*c*5 of the link 37*c* pivot to alternately set the third cam 37*b*3 at an actuation position (a position indicated by a solid line in FIG. 4) and a retreat position (a position indicated by a broken line in FIG. 4). Note that the actuation position of the third cam 37*b*3 of the delivery-side transfer cylinder 37 is the position through which the cam follower 37*a*2 of the delivery-side transfer cylinder 37 passes through the third cam 37*b*3 while engaging with it, at the transfer timing at which the gripper 37*a*1 of the gripper device 37*a* of the delivery-side transfer cylinder 37 is opposed to the gripper 38*a*1 of the gripper device 38*a* of the delivery cylinder 38. Also, the retreat position is the position through which the cam follower 37*a*2 of the delivery-side transfer cylinder 37 passes through the third cam 37*b*3 in a non-contact state.

As the second switching cam 73 rotates while the cam follower 82 is pressed against the cam surfaces 73*a* and 73*b* of the second switching cam 73, the levers 80 and 81 swing along the cam surfaces 73*a* and 73*b*. With this operation, the shaft 38*c*1 pivots, and the arm portions 38*c*4 and 38*c*5 of the link 38*c* pivot to alternately set the second cam 38*b*2 at an actuation position (a solid line in FIG. 4) and a retreat position (a broken line in FIG. 4). The actuation position of the second cam 38*b*2 of the delivery cylinder 38 is the position through which the cam follower 38*a*2 of the gripper device 38*a* of the delivery cylinder 38 passes through the second cam 38*b*2 while engaging with it, at the transfer timing at which the gripper 37*a*1 of the gripper device 37*a* of the delivery-side transfer cylinder 37 is opposed to the gripper 38*a*1 of the gripper device 38*a* of the delivery cylinder 38. Also, the retreat position is the position through which the cam follower 38*a*2 of the gripper device 38*a* of the delivery cylinder 38 passes through the second cam 38*b*2 while engaging with it, after the transfer timing.

When the gripper device 37*a* of the delivery-side transfer cylinder 37 grips the sheet S1 printed on its one surface, the cam follower 51 of the lever 50 is in contact with the cam surface 72*b* of the first switching cam 72. The cam follower 37*a*2 of the gripper device 37*a* of the delivery-side transfer cylinder 37 passes through the third cam 37*b*3, set at a retreat position, in a non-contact state. With this operation, the gripper 37*a*1 of the gripper device 37*a* of the delivery-side transfer cylinder 37 passes through the contact portion between the delivery-side transfer cylinder 37 and the delivery cylinder 38 in a closed state while holding the sheet S1.

On the other hand, the cam follower 38*a*2 of the gripper device 38*a* of the delivery cylinder 38 passes through the cam surface of the second cam 38*b*2 while engaging with it after the timing of transfer of the sheet S1 by the second cam 38*b*2 set at a retreat position. With this operation, when the gripper 38*a*1 of the gripper device 38*a* of the delivery cylinder 38 is opposed to the gripper 37*a*1 of the gripper device 37*a* of the delivery-side transfer cylinder 37, the gripper 38*a*1 of the gripper device 38*a* of the delivery cylinder 38 passes in an open state.

With this operation, the sheet S1 with its leading edge held by the gripper 37*a*1 of the gripper device 37*a* of the delivery-side transfer cylinder 37 is conveyed onto the pre-reversal double-diameter cylinder 39 with rotation of the delivery-side transfer cylinder 37 without being transferred by a gripping change to the gripper 38*a*1 of the gripper device 38*a* of the delivery cylinder 38.

Figure 8C:
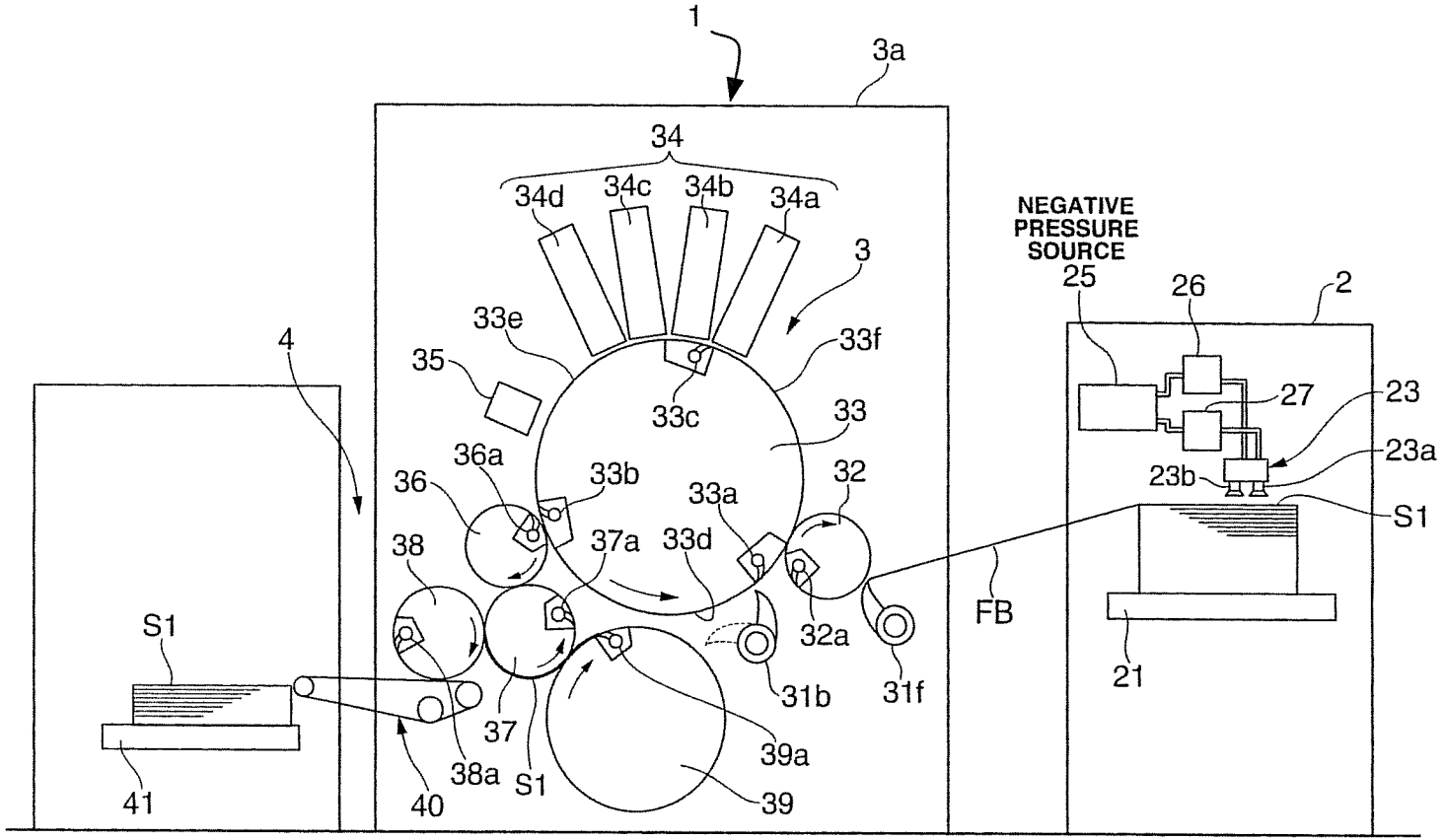

As shown in FIGS. 6 and 8C, when the sheet S1 passes through the contact portion between the delivery-side transfer cylinder 37 and the pre-reversal double-diameter cylinder 39, the cam follower 39*a*2 of the gripper device 39*a* of the pre-reversal double-diameter cylinder 39 passes along the cam surface of the fixed cam 39*b*. With this operation, the gripper 39*a*1 opens/closes through the lever 39*a*3, so the leading edge of the sheet S1 held by the gripper 37*a*1 of the gripper device 37*a* of the delivery-side transfer cylinder 37 is gripped by the gripper 39*a*1 of the gripper device 39*a* of the pre-reversal double-diameter cylinder 39.

When the cam follower 37*a*2 of the gripper device 37*a* of the delivery-side transfer cylinder 37 passes through the cam surface of the second cam 37*b*2 while engaging with it, the gripper 37*a*1 opens through the lever 37*a*3 to cancel holding of the sheet S1 by the gripper 37*a*1. With this operation, the sheet S1 is transferred by a gripping change from the gripper device 37*a* of the delivery-side transfer cylinder 37 to the gripper device 39*a* of the pre-reversal double-diameter cylinder 39. When the cam follower 37*a*2 passes through the cam surface of the second cam 37*b*2, the gripper 37*a*1 closes.

Figure 8D:
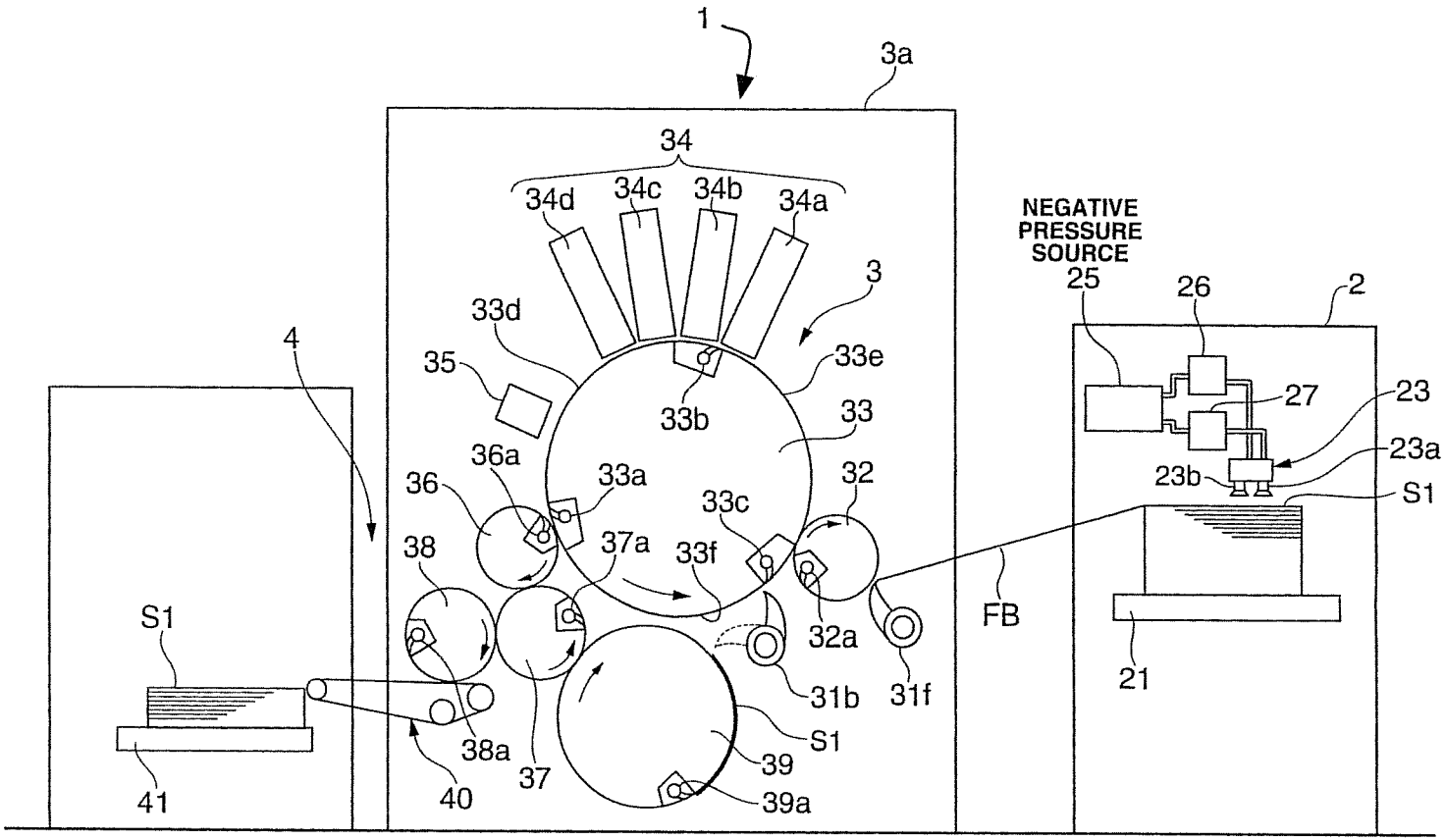

As shown in FIGS. 6 and 8D, the sheet S1 held by the gripper device 39*a* of the pre-reversal double-diameter cylinder 39 is conveyed with rotation of the pre-reversal double-diameter cylinder 39. When the trailing edge of the sheet S1 as its other edge is opposed to the reception position (broken line) of the reversing swing arm shaft pregripper 31*b*, the trailing edge (rear edge) of the sheet S1 is held by the reversing gripper device 31*bt* (FIG. 2) of the reversing swing arm shaft pregripper 31*b*.

At the same time, the cam follower 39*a*2 of the gripper device 39*a* of the pre-reversal double-diameter cylinder 39 passes through the cam surface of the movable cam 39*d* while engaging with it (a solid line in FIG. 6). Then, the gripper 39*a*1 opens through the lever 39*a*3 to cancel holding of the leading edge (front edge), that is, one edge of the sheet S1 held by the gripper 39*a*1 of the gripper device 39*a*. With this operation, the sheet S1 is transferred by a gripping change from the gripper device 39*a* of the pre-reversal double-diameter cylinder 39 to the reversing gripper device 31*bt* of the reversing swing arm shaft pregripper 31*b*.

In selecting the double-sided printing mode, the control device 100 controls the sheet size adjusting motor 108 based on the size (the dimension in the sheet conveyance direction) of the sheet S1 input to the sheet size input device 102 prior to the operation of the digital printing apparatus 1. As the sheet size adjusting motor 108 operates, the segment gear 39*c* moves from a position indicated by a solid line to that indicated by an alternate long and two short dashed line through the pinion 39*cp*, and the movable cam 39*d* moves from a position indicated by a solid line to that indicated by an alternate long and two short dashed line with movement of the segment gear 39*c*. With this operation, when the trailing edge (rear edge) of the sheet S1 is opposed to the reception position of the reversing swing arm shaft pregripper 31*b* and held by the reversing gripper device 31*bt*, the movable cam 39*d* is set at the position at which it engages with the cam follower 39*a*2 of the gripper device 39*a* of the pre-reversal double-diameter cylinder 39.

Figure 8E:
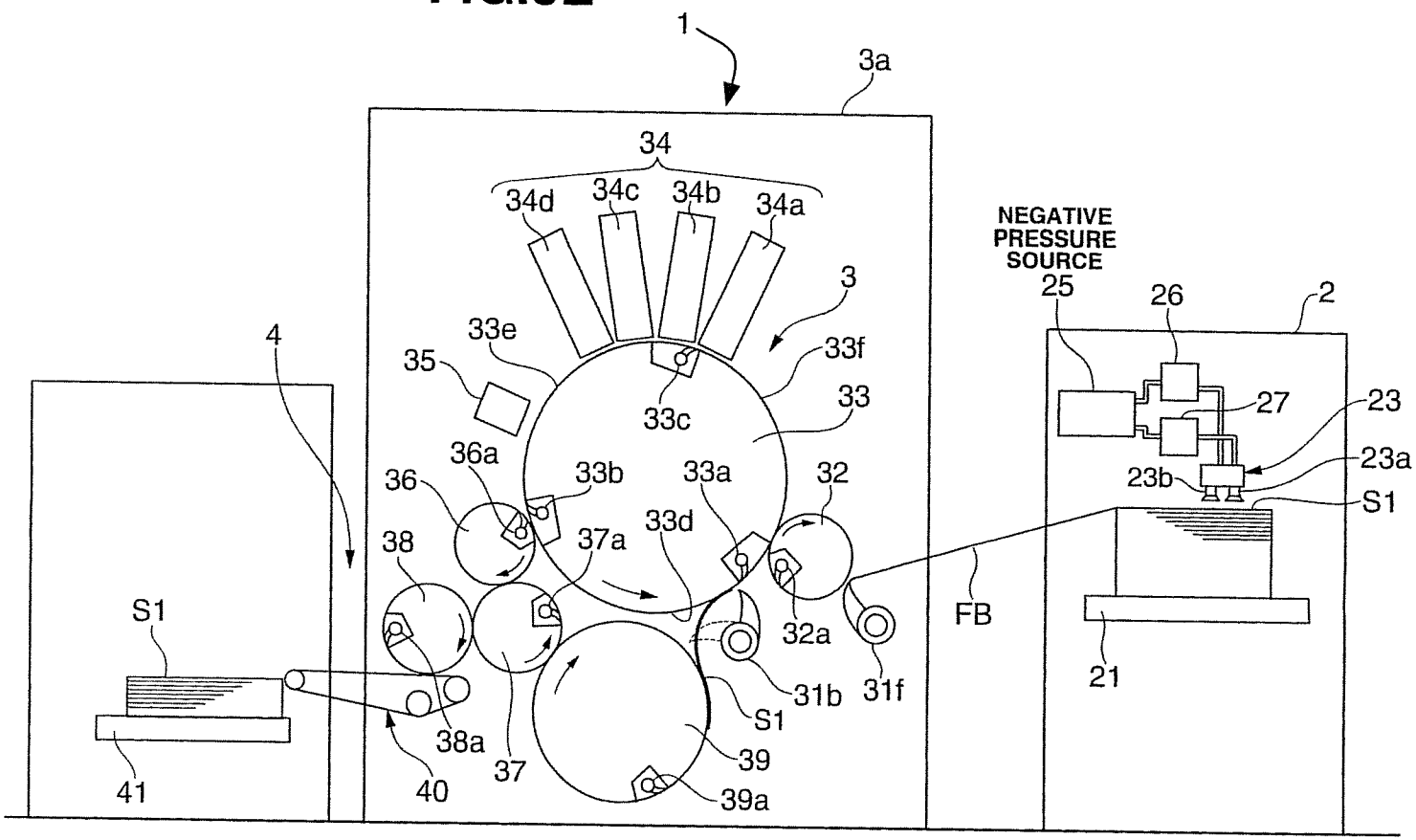

As shown in FIG. 8E, upon the swing operation of the reversing swing arm shaft pregripper 31*b* from a reception position (broken line) to a transfer position (solid line), the sheet S1 is conveyed onto the printing cylinder 33 with its trailing edge leading. When the cam follower 33*a*2 of the gripper device 33*a* of the printing cylinder 33 passes through the cam surface of the first cam 33*k*1 while engaging with it, the gripper 33*a*1 opens/closes through the lever 33*a*3. With this operation, the trailing edge of the sheet S1 held by the reversing gripper device 31*bt* of the reversing swing arm shaft pregripper 31*b* is gripped by the gripper 33*a*1 of the gripper device 33*a* of the printing cylinder 33. As the reversing gripper device 31*bt* of the reversing swing arm shaft pregripper 31*b* cancels holding of the leading edge of the sheet S1, the trailing edge of the sheet S1 is transferred by a gripping change from the reversing gripper device 31*bt* of the reversing swing arm shaft pregripper 31*b* to the gripper 33*a*1 of the gripper device 33*a*. At this time, the obverse surface of the sheet S1 having undergone digital printing is opposed to the circumferential surface (support surfaces 33*d*, 33*e*, and 33*f*) of the printing cylinder 33, and the reverse surface of the sheet S1 is held by the printing cylinder 33 while facing outwards. Therefore, the sheet S1 is turned when it is transferred from the reversing swing arm shaft pregripper 31*b* to the printing cylinder 33 by a gripping change.

Even when the sheet S1 is transferred from the reversing swing arm shaft pregripper 31*b* onto the printing cylinder 33, every other sheet S1 is intermittently fed by the delivery-side transfer cylinder 37. Therefore, at the timing at which the sheet S1 is transferred from the reversing swing arm shaft pregripper 31*b* onto the printing cylinder 33, the feed-side transfer cylinder 32 is opposed to the gripper device 33*a* of the printing cylinder 33 which holds no new sheet S1 conveyed from the feed-side transfer cylinder 32. In this manner, by setting the timing of transfer from the reversing swing arm shaft pregripper 31*b*, a new sheet S1 conveyed from the feed-side transfer cylinder 32 does not interfere with a turned sheet S1 conveyed from the reversing swing arm shaft pregripper 31*b* for reverse printing.

As the printing cylinder 33 rotates, the gripper device 33*a* having received the sheet S1 printed on its one surface is opposed to the gripper device 32*a* of the feed-side transfer cylinder 32. At this time, the gripper device 32*a* of the feed-side transfer cylinder 32 holds no sheet S1 by intermittent sheet feed of the sucker device 23. The cam follower 32*a*2 of the gripper device 32*a* of the feed-side transfer cylinder 32 passes along the cam surface of the second cam 32*b*2 while engaging with it, before the transfer timing of the sheet S1 by the second cam 32*b*2 set at a retreat position. Hence, when the gripper 32*a*1 of the gripper device 32*a* of the feed-side transfer cylinder 32 is opposed to the gripper 33*a*1 of the gripper device 33*a* of the printing cylinder 33 which holds the sheet S1, it passes in an open state.

Since the second cam 33*k*2 of the gripper device 33*a* of the printing cylinder 33 is set at a retreat position, the cam follower 33*a*2 of the gripper device 33*a* passes through the second cam 33*k*2 without abutting against it. Also, the gripper 33*a*1 of the gripper device 33*a* of the printing cylinder 33 is opposed to the gripper 32*a*1 of the gripper device 32*a* of the feed-side transfer cylinder 32 and passes in a closed state. With this operation, at the timing at which no sheet S1 is supplied by intermittent sheet feed of the sucker device 23, the gripper devices 33*a*, 33*b*, and 33*c* of the printing cylinder 33 hold the sheet S1 printed on its one surface, and pass through the contact portion with the feed-side transfer cylinder 32.

With this arrangement, the gripper devices 33*a*, 33*b*, and 33*c* of the printing cylinder 33 alternately hold a new sheet S1 from the sucker device 23, and a sheet S1 printed on its one surface from the reversing swing arm shaft pregripper 31*b*, and convey them to the inkjet nozzle portion 34.

The control device 100 controls the inkjet nozzle heads 34*a* to 34*d* of the inkjet nozzle portion 34 to perform reverse printing on a turned sheet S1 printed on its one surface based on the output from the rotary encoder 103, and perform obverse printing on a new sheet S1 from the sucker device 23. With this operation, the inkjet nozzle heads 34*a* to 34*d* alternately perform obverse printing and reverse printing corresponding to new and turned sheets S1 alternately held by the printing cylinder 33.

The sheet S1 printed on its reverse surface is discharged from the delivery belt 40 onto the pile board 41 of the sheet delivery device 4 sequentially through the delivery-side transfer cylinders 36 and 37 and delivery cylinder 38, as in the single-sided printing mode.

As described above, according to this embodiment, digital printing processes for the obverse and reverse surfaces of the sheet S1 are performed using the same printing cylinder 33 and the same inkjet nozzle portion 34. This allows a more efficient double-sided printing process on the sheet S1 with space saving, compared to the case wherein a printing cylinder and inkjet nozzle portion for a reverse printing process are provided separately.

Also, according to this embodiment, in sequentially transferring a sheet S1 onto the feed-side transfer cylinder 32, printing cylinder 33, delivery-side transfer cylinders 36 and 37, pre-reversal double-diameter cylinder 39, and reversing swing arm shaft pregripper 31*b*, the sheet S1 is conveyed while always being kept in a gripped state by the respective gripper devices through the cam surfaces of the corresponding cams. This makes it possible to obtain high registration accuracy and high obverse/reverse registration accuracy of the obverse and reverse surfaces of the sheet S1 in the conveyance direction or widthwise direction of the sheet S1, thus improving the printing quality of the sheet S1.

Moreover, according to this embodiment, an operation of opening/closing the respective gripper devices through the cam surfaces of the corresponding cams in the feed-side transfer cylinder 32, printing cylinder 33, delivery-side transfer cylinder 37, and delivery cylinder 38 is mechanically executed. This allows a reliable gripping change operation of the sheet S1.

Other Embodiments

Note that in the above-mentioned embodiment, the present invention is applied to a digital printing apparatus 1 serving as a sheet processing apparatus which performs a digital printing process on the sheet S1 by the printing cylinder 33 and inkjet nozzle portion 34. The present invention is not limited to this, and various processes including an offset printing process, inspection process, foil transfer process, and embossing process may be applied to a sheet processing apparatus on the sheet S1.

Also, in the above-mentioned embodiment, the sheet S1 is discharged or turned using the delivery-side transfer cylinders 36 and 37, delivery cylinder 38 or pre-reversal double-diameter cylinder 39, and reversing swing arm shaft pregripper 31*b* in the subsequent stage of the printing cylinder 33. The present invention is not limited to this, and the pre-reversal double-diameter cylinder 39 may be set in contact with the printing cylinder 33, and the delivery belt 40 may be disposed below the pre-reversal double-diameter cylinder 39 to directly transfer the sheet S1 from the printing cylinder 33 onto the pre-reversal double-diameter cylinder 39, and convey it onto the delivery belt 40. Alternatively, the sheet S1 held by the pre-reversal double-diameter cylinder 39 may be turned by the reversing swing arm shaft pregripper 31*b* and supplied onto the printing cylinder 33.

Moreover, although the printing cylinder 33 implemented by a triple-diameter cylinder is used as a printing cylinder in the above-mentioned embodiment, the present invention is not limited to this, and a printing cylinder implemented by a double-, quadruple- or more multiple-diameter cylinder may be used.

What is claimed is:

1. A sheet processing apparatus comprising:

a sheet supply device which supplies sheets one by one;

a first cylinder which comprises at least one gripper device that grips a first edge of the sheet supplied from said sheet supply device, and grips and conveys the sheet by said gripper device;

a processing device which processes the sheet conveyed by said first cylinder;

a sheet discharge device which discharges the sheet processed by said processing device; and conveyance devices which include a plurality of gripper devices including at least one reversing gripper device that grips and holds the a second edge of the sheet, convey the sheet that has undergone a single-sided process and is received from said first cylinder while sequentially transferring the sheet by a gripping change by said plurality of gripper devices, reverse the sheet in the process of conveyance, and supply the sheet onto said first cylinder, said conveyance devices comprising a second cylinder which grips and conveys a first edge of the sheet by one gripper device of said plurality of gripper devices, and a reversing swing arm shaft pregripper which is supported to be swingable between said first cylinder and said second cylinder, receives by said reversing gripper device the second edge of the sheet conveyed by said second cylinder, rotates in a first direction directed from said second cylinder to said first cylinder, transfers the received second edge of the sheet to said gripper device of said first cylinder by a gripping change, and rotates in a second direction opposite to the first direction.

2. The apparatus according to claim 1, further comprising conveyance path switching devices which switch a conveyance destination of the sheet from said first cylinder to one of said sheet discharge device and said second cylinder.

3. The apparatus according to claim 2, wherein said conveyance path switching devices further comprise an upstream gripper device which includes a first gripper that grips the sheet, and grips and holds by said first gripper the sheet from said first cylinder, an upstream cam which is supported movably, and opens/closes said first gripper of said upstream gripper device, and upstream cam switching devices which move said upstream cam, a downstream gripper device which includes a second gripper that grips the sheet, and grips and holds by said second gripper the sheet from said upstream gripper device, a downstream cam which is supported movably, and opens/closes said second gripper of said downstream gripper device, downstream cam switching devices which move said downstream cam, a process mode selection switch which selects a single-sided process mode in which said processing device performs a process on one surface of the sheet, and a double-sided process mode in which said processing device performs a process on two surfaces of the sheet, and a control device which controls said upstream cam switching device and said downstream cam switching devices based on the selection output of said process mode selection switch.

* * * * *